US005547800A

United States Patent [19]

Nishimori et al.

[11] Patent Number: 5,547,800

[45] Date of Patent: Aug. 20, 1996

[54] TONER AND ELECTROPHOTOGRAPHIC IMAGE FORMING METHOD USING THE SAME

[75] Inventors: Yoshiki Nishimori; Tsugio Abe; Yuriko Suzuki, all of Hachioji, Japan

[73] Assignee: Konica Corporation, Japan

[21] Appl. No.: 445,448

[22] Filed: May 23, 1995

[30] Foreign Application Priority Data

Jun. 6, 1994 [JP] Japan ..... 6-123928

[51] Int. Cl.[6] ..... G03G 9/087

[52] U.S. Cl. ..... 430/110

[58] Field of Search ..... 430/110, 109, 430/111

[56] References Cited

U.S. PATENT DOCUMENTS 5,110,704 5/1992 Inoue et al. ..... 430/110

5,384,224 6/1995 Tanikawa et al. ..... 430/110

*Primary Examiner*—John Goodrow

*Attorney, Agent, or Firm*—Jordan B. Bierman; Bierman and Muserlian

[57] ABSTRACT

A toner for developing an electrophotographic image and a method for forming an electrophotographic image using the toner. The toner comprises a binder and a colorant, in which a volume average diameter of the toner particles, Dv in μm, and a storage modulus at 170° C. thereof, $G'_{170}$ in dyne/cm$^2$, satisfy the following relation;

$$-(2/15)Dv+3.5 \leqq \log G'_{170} \leqq -(3/15)Dv+5.5.$$

In the method, an electrophotographic image is developed by the above-mentioned toner and fixed by a fixing roller covered with a surface layer comprising a fluorine-containing resin.

6 Claims, 3 Drawing Sheets

TONER AND ELECTROPHOTOGRAPHIC IMAGE FORMING METHOD USING THE SAME

BACKGROUND OF THE INVENTION

The present invention relates to a toner used for formation of images by means of electrophotography. Also, the present invention relates to a method of image formation in which the toner is used.

In the image formation of electrophotography, toner is fixed onto an image support by the method of heat roller fixing, so that a permanent visible copied image can be provided. When a transparency sheet for use in an overhead projector, which will be referred to as an "OHP sheet" hereinafter, is used as an image support and a copied color toner image is formed on an OHP sheet, it is necessary, particularly when color toner is used, to make the image surface smooth so as to enhance the optical transmittance in the case of projecting the image by an overhead projector. That is, it is required to fix the toner image smoothly on the OHP sheet surface so as to prevent the scatter and irregular reflection of transmitted light on the image surface.

In order to accomplish the above object, conventionally, a color toner which is capable of sharply transiting to a molten state of a visco-elasticity lower than that of ordinary black toner at the milting point thereof is used, and the surface of a formed color toner image is easily made to be smooth when the image is heated and pressed by a heat roller for fixation.

However, when the visco-elasticity of toner is lowered, the glass transition point of the toner is also lowered. Therefore, at a normal temperature or a temperature in an octual machine which the toner is used, the mechanical strength of the toner is deteriorated. Accordingly, when a mechanical force is impressed upon the toner particle by agitating in the developing apparatus, additive on the surface of the toner particle is embedded in the toner particle, and the performance of development and transfer of it is deteriorated. Further, adhesion of toner particles to carrier particles occurs. These problems are remarkably caused when the sizes of toner particles are reduced to enhance the image quality recently. The reason is that the smaller the toner particle size becomes, the more the toner particle is subjected to mechanical stress.

When the color toner with a low visco-elasticity is used, other problems are caused, which will be described below. Even when a releasing agent is added to toner so as to improve the releasing property in the fixing process, the viscosity of toner and that of the releasing agent are close to each other, so that the releasing agent does not function substantially. For this reason, in order to prevent the occurrence of hot offset in the fixing process, it is necessary to coat the surface of a fixing roller with silicon oil. As a result, in a copie image on OHP sheets support, a sufficiently high transmittance of image switable for projection by OHP hardly be obtaine because sticky silicon oil is coated unevenly on the surface. Further, it is necessary to enhance the wettability of silicon oil on the surface of a fixing roller. Therefore, it is substantially impossible to provide a coating layer of high releasing property made of fluororesin on the fixing roller. Accordingly, it is inevitable to use silicon rubber to make the fixing roller. As a result, the durability of the fixing roller is very low.

The present invention has been achieved to solve the above problems. It is an object of the present invention to provide a toner by which a smooth fixed copied image can be formed on an OHP sheet, so that a sufficiently high transmittance is maintained; and the mechanical strength of toner particles is sufficiently high and additive is not embedded in the toner particles even in the case of toner particles of small size.

It is another object of the present invention to provide a technique of forming a copied image, when a releasing agent is added to toner, it is possible to prevent the occurrence of hot offset in the fixing process and it is not necessary to coat silicon oil on the surface of a fixing roller, so that a copied image can be formed on an OHP sheet on which sticky silicon oil is not provided and there is no oil coated unevenly.

It is still another object of the present invention to provide a technique in which it is substantially unnecessary to coat silicon oil on the surface of a fixing roller; and it is possible to provide a covering layer of high releasing property made of fluororesin on the surface of the fixing roller, so that the durability of the fixing roller can be improved.

SUMMARY OF THE INVENTION

The above object of the invention can be achieved by a toner for developing an electrophotographic image comprising a binder and a colorant, in which a volume average diameter of toner particles, Dv in μm, and a storage modulus at 170° C. thereof, $G'_{170}$ in dyne/cm$^2$, satisfy the following relation;

$$-(2/15)Dv+3.5 \leq \log G'_{170} \leq -(3/15)Dv+5.5,$$

and a image forming method comprising the steps of developing a electrophotographic latent image to form a toner image with the above-mentioned toner, and fixing said toner image using a fixing roller which is covered by a surface layer comprising a fluorine-containing resin.

It is preferable that the toner contains a releasing agent and the fixing step is carried out by using a fixing roll covered by a surface layer comprising a fluorine-containing resin. The above method is particularly effective when the toner is a color toner containing a chromatic colorant.

DETAILED DESCRIPTION OF THE INVENTION

Figure 2:
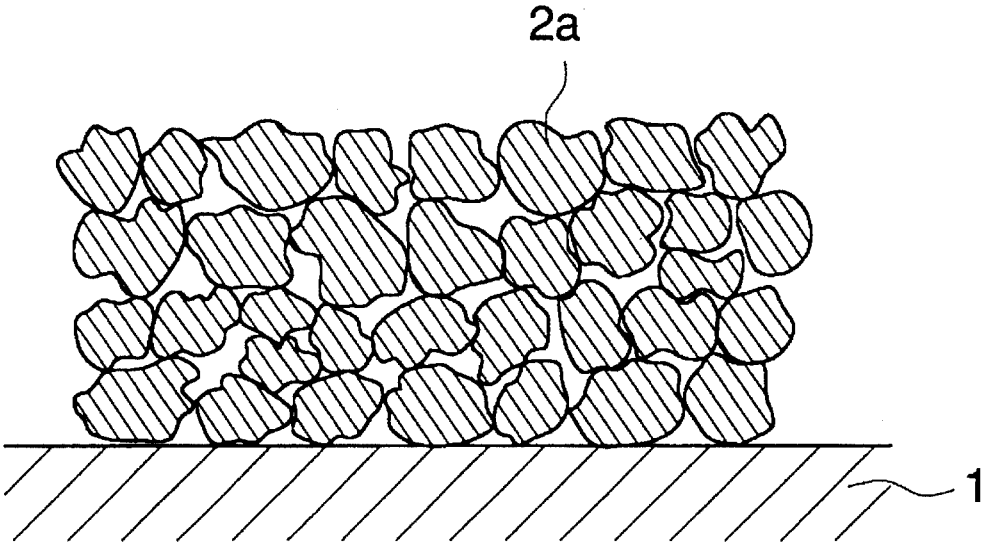
FIG. 2 is a sectional view showing a model of the image before fixation composed of toner of small particle size.

According to the present invention, a preferable visco-elasticity of toner is determined in accordance with the toner particle size. Specifically, the visco-elasticity of toner is determined in the following manner: In the case of toner particles, the sizes of which are small, the visco-elasticity of toner is designed to be high, so that the mechanical strength of the toner particles is enhanced. In this way, additive is not embedded in the toner particles and further the occurrence of adhesion of toner to carrier can be prevented. Although the high visco-elasticity is disadvantageous in smooth fixation, as a model is shown in FIG. 2, on the image before fixation formed from toner particles of small size, irregularities on the surface are small so that the surface is substantially smooth, and further the heat capacity of toner particles is small. Therefore, even when the toner particles are highly visco-elastic, a smooth fixed image can be formed from the toner of small particle size. In FIG. 2, numeral 1 is an OHP sheet, and numeral 2*a* is a toner particle.

Figure 3:
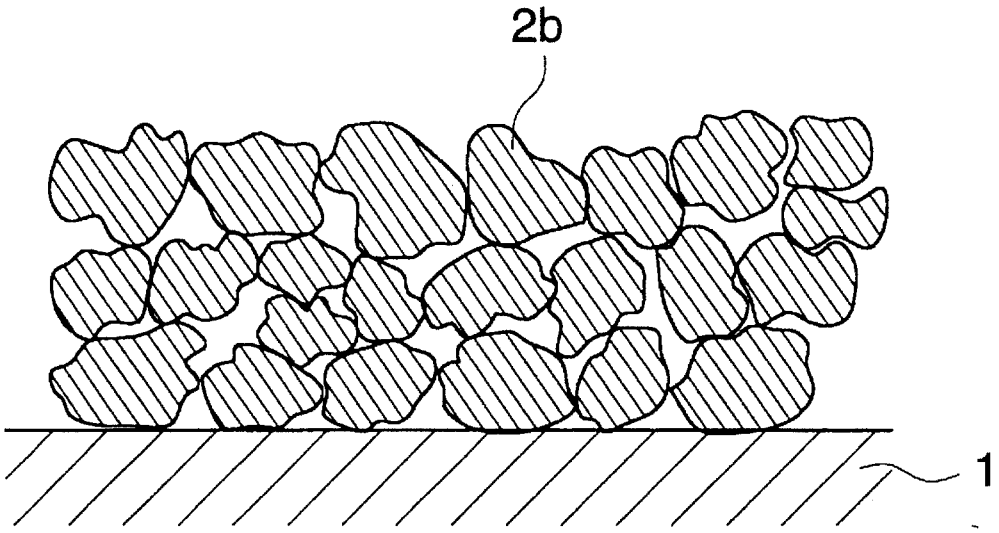
FIG. 3 is a sectional view showing a model of the image before fixation composed of toner of large particle size.

On the contrary, when the toner particle size is increased, as a model is shown in FIG. 3, irregularities on the image surface are large before fixation. Further, when the toner particle size is increased, the heat capacity is also increased. Therefore, it is necessary to design the visco-elasticity to be low so that the toner image can be easily fixed. In this case, when the visco-elasticity is designed to be low, the mechanical strength is lowered. However, when the toner particle size is increased, the toner particles are less susceptible to stress given from the outside. Therefore, it is possible to prevent the additive from being embedded in the toner particles. Also, it is possible to prevent the occurrence of adhesion of toner particles to carrier particles. In FIG. 3, numeral 1 is an OHP sheet, and numeral 2*b* is a toner particle.

The inventors made an investigation into the correlation between the particle size and visco-elasticity of toner particles. As a result of the investigation, they found the following:

When a toner is used having a preferable visco-elasticity in accordance with the toner particle size so that the volume average particle size Dv (μm) of toner and the storage modulus $G'_{170}$ (dyne/cm$^2$) at 170° C. can satisfy the requirement described before, it is possible to provide a smooth fixed image surface and it is also possible to prevent the deterioration of mechanical strength.

When the visco-elastic characteristic of toner is designed to be in the above range, the following advantages can be obtained:

When a releasing agent is added into toner, the viscosity of toner becomes higher than that of the releasing agent in the process of melting, so that the function of the releasing agent is completely fulfilled. Accordingly, even if the surface of a fixing roller is not coated with silicon oil, the occurrence of hot offset can be prevented. As a result, the wettability of silicon oil onto the fixing roller surface is not required. Therefore, it becomes possible to provide a covering layer made of fluororesin having a high releasing property on the fixing roller surface. In this way, the durability of the fixing roller can be greatly enhanced as compared with a case in which silicon rubber is used on the fixing roller surface.

In the case where the inequality expressing a relation between the particle size and visco-elasticity is not satisfied, that is, in the case of $\log G'_{170} < -(2/15)Dv+3.5$, the mechanical strength is greatly lowered, and it is impossible to prevent the additive from being embedded in toner particles, and it is also impossible to prevent the occurrence of adhesion of toner particles to carrier particles. Further, the off-set hardly be prevented even when a releasing agent is added to the toner because the viscosity of the toner in a molten state and that of the releasing agent become near and the effect of the releasing agent is lowered. On the contrary, in the case of $\log G'_{170} > -(3/15)Dv+5.5$, it becomes difficult to fix an image having a smooth surface. Therefore, it is impossible to provide a projection image from a copied image having an excellent transmitted color.

In the present invention, Dv and $G'_{170}$ are measured by the following method.

Measurement of Dv:

Coulter Counter particle size distribution meter of type "TA-II" is used. The volume average particle size in the case of an aperture of 100 μm is defined as Dv.

Measurement of $G'_{170}$:

Rheometer "Soliquid Meter of type MR-3" manufactured by Nippon Rheology is used. Corn/plate method is employed under the following condition. Cone angle is 1.8°. Cone diameter is 32.0 mm. Wire diameter is 1.0 mm. Frequency is 0.1 Hz. Twist angle is 2.0°. Measurement temperature is set at 170° C. Measurement is made every 30 seconds, and a curve showing a relation between the storage elastic modulus G' and the measurement time is obtained. A value of G' obtained by the extrapolation to "the measurement time=0" on the curve is used as the storage modulus of toner at 170° C., that is, the value of G' is used as the value of $G'_{170}$ (dyne/cm$^2$).

It should be noted that the material of toner and fixing process are not limited to specific examples as long as the object of the present invention can be accomplished. Preferable embodiments to exhibit the effect of the present invention more effectively will be described below.

Materials composing toner are a binder resin and other necessary materials such as a coloring agent, releasing agent, electric charge control agent, additive and lubricant. Commonly used materials may be applied to these materials.

The binder resin used for the present invention may be selected from commonly known materials. Examples of usable binder resins include homopolymers or copolymers derived from styrene, acrylic acid and acrylic ester, methacrylic acid and methacrylic ester, acrylonitrile and acrylonitrile, polyester, polyurethane, and polyamide. In order to provide a visco-elastic characteristic appropriate to the present invention, a conventional straight chain structure type binder resin of low molecular weight is not preferably used, but a high dimensional structure type binder resin, which has a cross-linking structure a little or a molecular weight distribution having double peaks, is preferably used.

The storage modulus required in the invention can be given to the toner by controlling an average molecular weight, distribution of molecular weight or degree of cross-linking of these resins. For Controlling these factors, the synthesis conditions of the resin are appropriately operated as the followings. In the case of the resin is formed by stepwise polymerization such as polyester resin, for example, temperature and time of the polymerization reaction are controlled. In a chain reaction polymerization system, such as in a styrene-acryl resin, the average molecular weight of the resin can be controlled by changing an amount of an polymerization initiator, and the molecular weight distribution of the resin can be controlled by dividing the polymerization reaction to two or more steps. Further, the cross-linking degree of the resin can be controlled by such a method in which a cross-linking monomer is used and the content of such monomer is varied for adjust the cross-linking degree.

In the present invention, "color toner" is a toner having a chromatic color such as yellow magenta or cyan other than black color.

Examples of the yellow colorant are C. I. Pigment Yellow Nos. 12, 13, 14, 15, 17, 55, 83 and 174 which are benzizine type yellow pigments. Examples of the magenta colorant are C. I. Pigment Red No. 122 which is quinacridone type magenta pigments, and C. I. Pigment Red No. 57:1 which is an azo-lake magenta pigment. Examples of the cyan coloring agent are C. I. Pigment Blue No. 15, 15:3, 15:4 and 15:6 which are copper-phthalocyanine pigments. When a black toner having the same visco-elastic characteristic as that of the present invention is made and used together with the color toner, carbon black and nigrosine dye are used as the black coloring agent.

Examples of usable releasing agents used in the present invention are: polyethylene of low molecular weight, polypropylene of low molecular weight, wax of amide, and polyhydric alcohol ester. Concerning the addition of a mold releasing agent, it is preferable that an amount of addition is maintained in a range of 0.5 to 15 weight parts with respect to the binder resin of toner. When the amount of addition is smaller than 0.5 weight part, a sufficiently high releasing performance can not be exhibited, and when the amount of addition is larger than 15 weight parts, transparence of color toner is deteriorated.

It is preferable that an achromatic or white electric charge control agent is used because the electric charge control agent composes a portion of color toner. Specifically, salicylic acid or zinc salt, which is a salicylic acid derivative, may be used.

Examples of usable additives are: inorganic fine particles of silica, alumina and titania; fine particles described above that have been made to be hydrophobic; organic fine particles such as silicone resin fine particles and fluorine resin fine particles; and lubricants such as metallic salt of higher fatty acid.

The value of Dv of the toner particles of the invention is preferably within the range of from 5 μm to 20 μm. The Dv value can be controlled by particle size classification after kneading and pulverizing of components of the toner such as resin and colorant so as to be within the above specified range.

Toner of the present invention is mixed with carrier, so that they are used as a two component developer. Concerning the carrier composing the two component developer, either the uncoated carrier composed of only particles of magnetic material such as iron and ferrite, or resin coated carrier, the particle surfaces of which are coated with resin. Concerning the average particle size of the carrier, it is preferable that the volume average particle size is 30 to 150 μm. Styrene-acrylic resin, which is conventionaly used, can be used as coating resin to coat the carrier particles.

Toner of the present invention is fixed onto an image support such as an OHP sheet by a fixing unit. It is preferable that the mechanical structure of the fixing unit is a heat roller fixing unit in which an elastic roller is used as a roller to be directly contacted with a toner layer provided on the image support, that is, an elastic roller is used as a fixing roller. When an elastic fixing roller is used, it is advantageous in that the surface of the fixing roller is deformed when it comes into contact with the irregularities on the surface of a toner image to be fixed. Accordingly, it is possible to uniformly fix the toner image. Concerning the elasticity of the fixing roller, it is preferable that the hardness of the fixing roller is in a range from 50° to 80°. When the hardness is lower than 50°, an amount of deformation of the fixing roller is excessively increased, and problems are caused in the threading property. When the hardness is higher than 80°, the surface of the fixing roller is not sufficiently deformed. Accordingly, it is difficult to uniformly heat the toner surface. In order to provide a fixing roller having an appropriate resilience, a resilient rubber layer made of silicon rubber or fluorine rubber may be attached onto the surface of the fixing roller. In this connection, the values of hardness described above are measured by Asker C hardness meter.

In the present invention, in order to provide a releasing property for the purpose of prevention of offset, a coating layer made of fluorine-containing resin may be provided on the surface of the fixing roller. It is preferable that the coating layer is made of polyfluorovinylidene fluoride, (PVF), polytetrafluoroethylene (PTFE), and tetrafluoroethylene-perfluoroalkoxyvinylether copolymer (PFA), and the surface energy of the coating layer is low. In this case, it is preferable that the coating layer is 20 to 70 μm thick.

EXAMPLE (Preparation of Example Toner 1 and Comparative Toner 1)

A polyester resin for binder was prepared by polymerization of 1.4 moles of bisphenol A.propylene oxide, 0.6 moles of bisphenol A.ethylene oxide, 0.6 moles of terephthalic acid and 0.8 moles of trimellitic acid at 200° C. for 4 hours. Thus obtained resin has a value of $G'_{170}$ of $1.6\times10^3$ dyne/cm$^2$.

The above binder resin and a magenta colorant, C. I. Pigment Red No. 122, were preliminarily mixed so that the weight ratio was 4: 6, and then melted and kneaded by a pressure kneader. After that, the mixture was cooled and solidified and roughly ground. In this way, a master batch pigment was prepared. Next, 100 weight parts of the above polyester resin, 20 weight parts of the thus obtained master batch pigment, and 3 weight parts of low molecular polypropylene wax to be used as a releasing agent were mixed by a Henschel mixer. Then the mixture was melted and kneaded by a twin screw extruder, and cooled and solidified. After that, the mixture was roughly ground and processed by a particle collision type pulverizer and air current type classifier, and colored particles of Dv=8.5 μm were obtained. These colored particles of Dv=8.5 μm were defined as Example Toner 1. In the same manner, colored particles of Dv=11 μm were obtained. These colored particles of Dv=11 μm were defined as the toner of Comparative Toner 1. In both toner of Example 1 and toner of Comparative 1, the value of $G'_{170}$ was $5.0\times10^3$ dyne/cm$^2$.

(Preparation of Example Toners 2 and 3, and Comparative Toner 2)

A polyester resin was prepared by polymerization of 2.0 moles of bisphenol A.propylene oxide, 0.75 moles of terephthalic acid and 0.75 moles of trimellitic acid at 200° C. for 3 hours. Thus obtained resin has a $G'_{170}$ value of $1.2\times10^3$ dyne/cm$^2$. Three kinds of samples, Example Toners 1 and 2 and Comparative Toner 2, each having a Dv values of 8.5 μm, 11 μm and 15 μm, respectively, were prepared in the similar manner as in the above Example Toner 1 except that the above resin and a yellow colorant, C. I. Pigment Yellow 17, were used as the binder and the colorant. These toners The $G'_{170}$ value of these toner were all $1.0\times10^3$ dyne/cm$^2$.

(Preparation of Example Toners 4 and 5 and Comparative Toner 3)

A resin prepared by solution polymerization of 1.5 moles of styrene, 0.5 moles of methyl methacrylate using 0.03 moles of di-tert-butyl peroxide as a polymerization initiator. Thus prepared resin was dissolved in 3.0 moles of styrene and 3.0 moles of methyl methacrylate and suspended in an aqueous medium, and further polymerized using 0.05 moles of benzoyl peroxide as a polymerization initiator to prepare a styrene-acrylate binder resin. Thus prepared resin has a value of $G'_{170}$ of $1.7\times10^3$ dyne/cm$^2$. Comparative Toner 3 having a Dv value of 8.5 μm was prepared in the same manner as in Example Toner 1, except that the above resin was used as the binder, a cyan pigment, C. I. Pigment Blue No. 15:3 was used as the colorant, and the amount of the master batch pigment was varied to 10 parts. Further, Example Toners 4 and 5 were prepared in the same manner as above except that the Dv values of them were adjusted to 11 μm and 15 μm, respectively. The values of $G'_{170}$ of these toners were all $1.6\times10^2$ dyne/cm$^2$.

(Preparation of Example Toner 6 and Comparative Toner 4)

A polyester resin for binder was prepared by polymerization of 2.0 of bisphenol A.polypropylene oxide and 2.0 moles of fumaric acid at 200° C. for 6 hours. Thus prepared resin has a value of $G'_{170}$ of $6.5\times10^3$ dyne/cm$^2$. Comparative Toner 4 and Example Toner 6 each respectively having a Dv used as the binder. The values of $G'_{170}$ of both toners were $6.4\times10^2$ dyne/cm$^2$.

Figure 1:
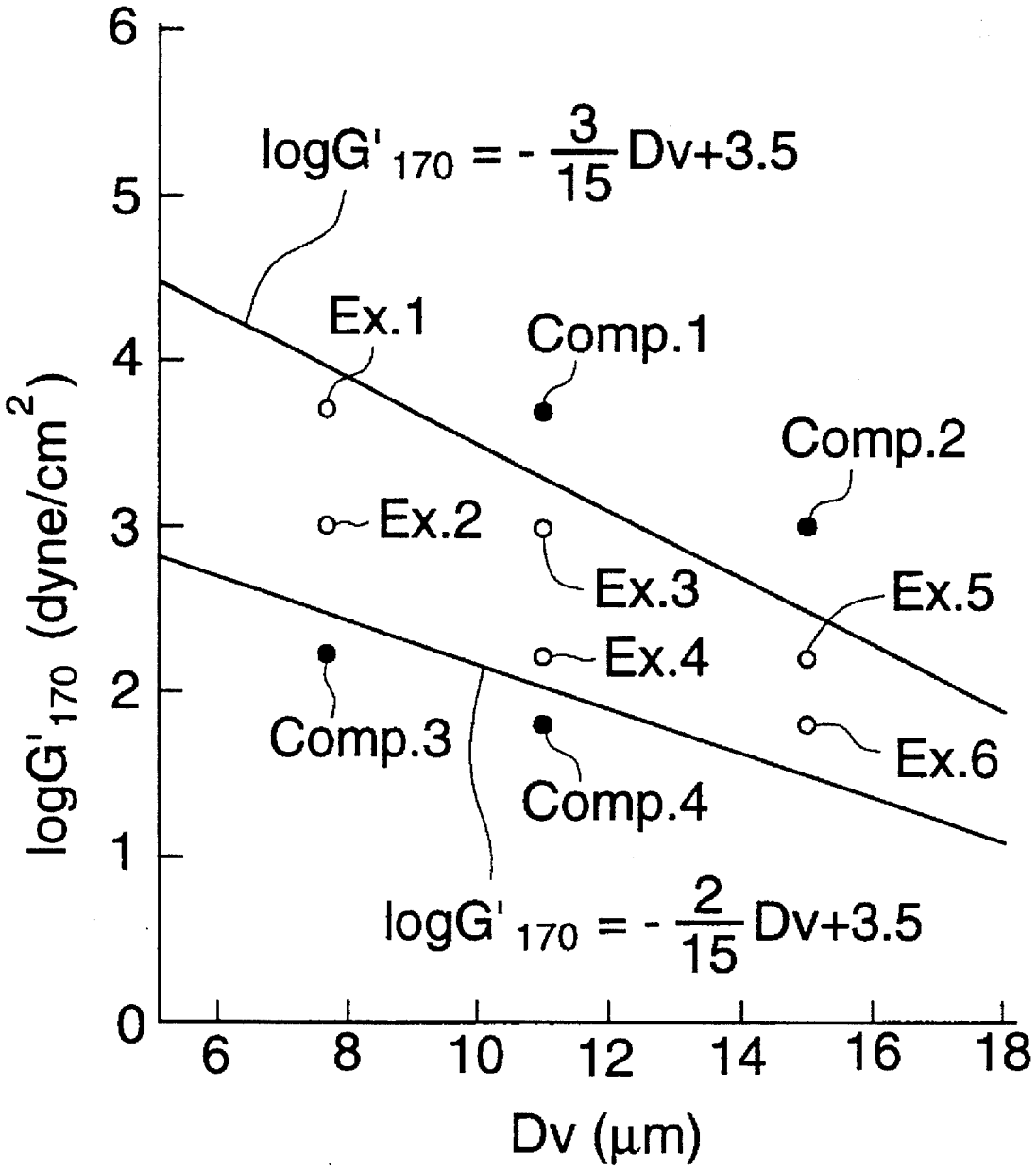
FIG. 1 is a graph showing a relation between the volume average particle size Dv (μm) of color toner of the present invention and the storage elastic modulus $G'_{170}$ (dyne/cm$^2$).

FIG. 1 shows a relation between the volume average particle diameter Dv (μm) and the storage modulus $G'_{170}$ (dyne/cm$^2$) of toners of Examples 1 to 6 and Comparative Examples 1 to 4. A region interposed between the straight line $\log G'_{170}=-(2/15)Dv+3.5$ and the straight line $\log G'_{170}=-(3/15)Dv+5.5$ is defined as a region in which the relation between the volume average particle size Dv (μm) of toner and the storage modulus $G'_{170}$ (dyne/cm$^2$) of the present invention is satisfied.

Toners of Examples 1 to 6 and Comparative Examples 1 to 4 were used as two-component developer in the following manner: As additive, 0.5 weight part of hydrophobic silica and 1.0 weight part of hydrophobic titania were added to and mixed with 100 weight parts of the above toner. Then, ferrite core carrier, the volume average particle size of which was 45 μm, and the surfaces of the particles of which were covered with styrene-methacrylate resin coating layers, was mixed with the toner so that the toner concentration could be 7 weight %. In this manner, the two-component developer was prepared.

Using the aforementioned developer, a solid image was formed on an OHP sheet under the condition that an amount of toner deposition was 0.7 mg/cm$^2$. The transmission property of the thus obtained image was evaluated and compared by the following method. In this connection, the Konica Full Color the thus obtained image was evaluated and compared by the following method. In this connection, the Konica Full Color Copier "DC9028" modified in the following manner was used as a fixing unit when the image was formed.

Construction of the Fixing Unit

Figure 4:
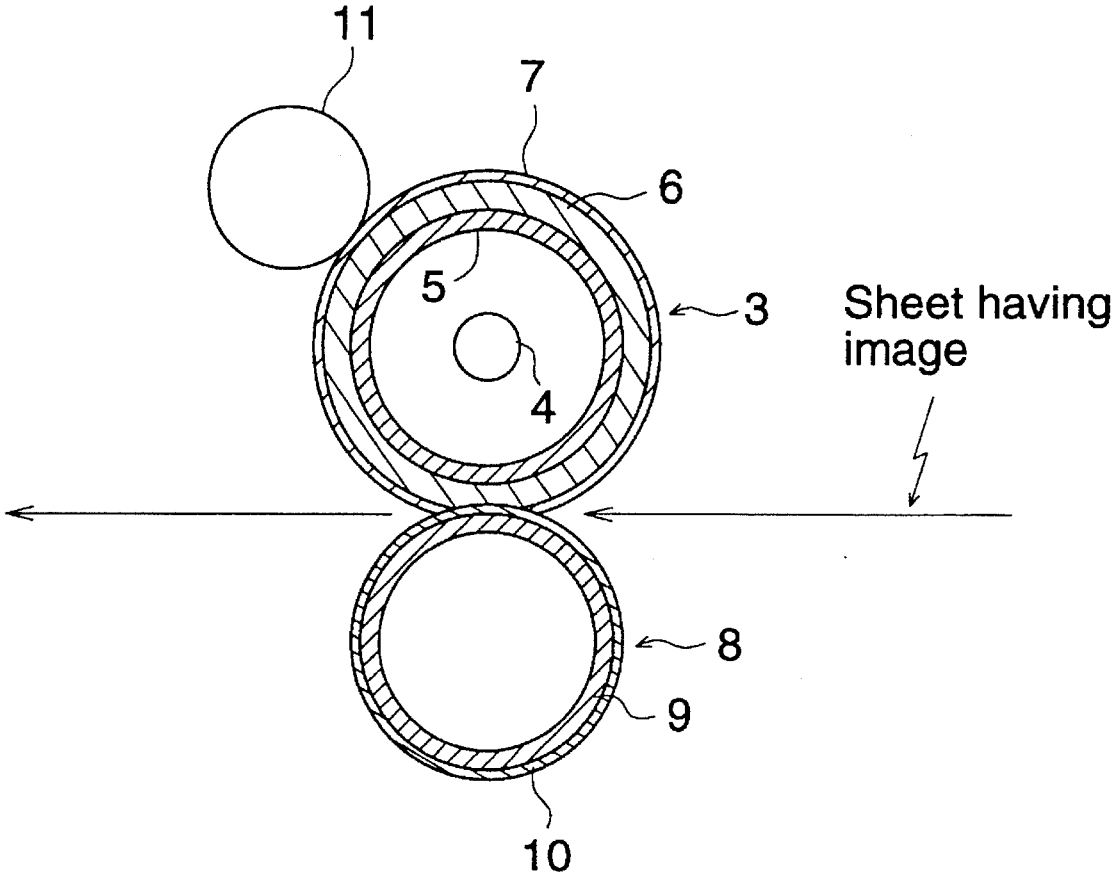
FIG. 4 is a sectional view showing an outline of the example of the fixing unit used for the image forming method of the present invention.

As illustrated in FIG. 4, there is provided a hollow roller 5 made of aluminum, the diameter of which is 30 mm. A halogen heater lamp 4, the capacity of which is 600 W, is installed at the center of the hollow roller 5. The surface of the hollow roller 5 is covered with a low temperature vulcanization (LTV) rubber layer 6, the rubber hardness measured by the Asker C hardness meter of which is 80°, and a PFA tube layer 7 of 50 μm thickness. In this manner, the fixing roller 3 is composed of the hollow roller 5, LTV rubber layer 6, and PFA tube layer 7. Also, there is provided a hollow roller 9 made of aluminum, the diameter of which is 30 mm. The surface of the hollow roller 9 is covered with a PFA tube layer 10 of 50 μm thickness. In this manner, the press roller 8 is composed of the hollow roller 9 and PFA tube layer 10. As described above, the fixing unit includes the fixing roller 3 and press roller 8. In FIG. 4, numeral 11 is a cleaning roller, and the arrow denotes a conveyance passage for conveying an OHP sheet on which a toner image has been formed. In this apparatus, the press roller is pressed against the fixing roller by the nipping press load of 2.5 kgf/cm$^2$.

Evaluation of Transmission Property of Image

An image was fixed under the condition that the linear speed of fixing was 25 mm/s and the surface temperature of the fixing roller was 190° C. Concerning the thus obtained image, the visible spectral transmittance of the image was measured with "the 330 type recording spectrophotometer" manufactured by Hitachi Seisakusho, wherein an OHP sheet on which a toner image was not formed was used as a reference. In the case of yellow toner, a difference between the spectral transmittance at 650 nm and that at 450 nm was found. In the case of magenta toner, a difference between the spectral transmittance at 650 nm and that at 550 nm was found. In the case of cyan toner, a difference between the spectral transmittance at 500 nm and that at 600 nm was found. By the thus found difference of the spectral transmittance, the transmission property of an OHP image was evaluated. When this value is not less than 70%, it can be judged that the transmission property is excellent.

Durability of the above developer was evaluated by the following method.

Evaluation of Durability of Developer

The Konica Full Color Copier "DC9028" was modified so that the developing unit was able to operate independently. Developers of the examples of the present invention and developers of the comparative examples were charged into the developing unit. Then the developer was agitated for 5 hours under the condition of 20° C. and 60% RH. Before and after the agitation, the developing property was found. That is, an amount of toner per unit area on the photoreceptor used for development was measured before and after the agitation, and a ratio of the developing property after agitation to that before agitation was found. By this ratio, the durability was evaluated. In the case where this value is not less than 90%, it can be judged that the durability is excellent. A change in the developer was observed by a scanning electron microscope, and it was checked whether the additive was embedded or not.

Results of evaluation are shown on Table 1.

TABLE 1

| | Dv (μm) | $G'_{170}$ (dyne/cm$^2$) | Transmission Property of OHP (%) | Durability: Developing Property (after/before agitation) (%) | Durability: Embedding of Additive |
|---|---|---|---|---|---|
| Example 1 | 7.5 | $5.0\times10^3$ | 74 | 94 | No occurrence |
| Example 2 | 7.5 | $1.0\times10^3$ | 77 | 91 | No occurrence |
| Example 3 | 11 | $1.0\times10^3$ | 72 | 94 | No occurrence |
| Example 4 | 11 | $1.6\times10^2$ | 80 | 90 | No occurrence |
| Example 5 | 15 | $1.6\times10^2$ | 71 | 92 | No occurrence |

TABLE 1-continued

| | Dv (μm) | $G'_{170}$ (dyne/cm$^2$) | Transmission Property of OHP (%) | Durability: Developing Property (after/before agitation) (%) | Durability: Embedding of Additive |
|---|---|---|---|---|---|
| Example 6 | 15 | $6.4 \times 10^1$ | 75 | 92 | No occurrence |
| Comparative Example 1 | 11 | $5.0 \times 10^3$ | 61 | 98 | No occurrence |
| Comparative Example 2 | 15 | $1.0 \times 10^3$ | 52 | 101 | No occurrence |
| Comparative Example 3 | 7.5 | $1.6 \times 10^2$ | 83 | 53 | Occurrence |
| Comparative Example 4 | 11 | $6.4 \times 10^1$ | 84 | 61 | Occurrence |

As can be seen from the results shown on Table 1, in Examples 1 to 6 in which the correlation between Dv and $G'_{170}$ stipulated in the present invention is satisfied, the transmission property of OHP and the durability of developer are stably high. On the other hand, in Comparative Examples 1 to 4 in which the correlation between Dv and $G'_{170}$ stipulated in the present invention is not satisfied, either the OHP transmission property or the durability of developer is low. In Comparative Examples 1 and 2, the inequality of $\log G'_{170} \geqq -(3/15)Dv+5.5$ is satisfied. Therefore, smooth fixed images were not formed, and the OHP transmission property was low. In Comparative Examples 3 and 4, the inequality of $\log G'_{170} \leqq -(2/15)Dv+3.5$ is satisfied. Therefore, the mechanical strength of toner was low. Accordingly, when the developer was agitated, the additive was embedded. As a result, the developing property was deteriorated.

What is claimed is:

1. A toner for use in a two-component developer for developing an electrophotographic image comprising a binder and a colorant, in which a volume average diameter of the toner particles, Dv in μm, and a storage modulus at 170° C. thereof, $G'_{170}$ in dyne/cm$^2$, satisfy the following relation;

$$-(2/15)Dv+3.5 \leqq \log G'_{170} \leqq -(3/15)Dv+5.5.$$

2. The toner of claim 1, wherein said toner further contains a releasing agent.

3. The toner of claim 2, wherein said releasing agent is a low molecular weight polyethylene, a low molecular weight polypropylene, an amide-type wax of a polyol ester.

4. The toner of claim 1, wherein the Dv value of said toner is within the range of 5 μm to 20 μm.

5. The toner of claim 1, wherein said toner is a color toner containing a chromatic colored colorant.

6. A method for forming an electrophotographic image comprising the steps of developing a electrophotographic latent image to form a toner image with a two-component developer containing a toner comprising a binder, and a colorant, in which a volume average diameter of toner particles, Dv in μm, and a storage modulus at 170° C. thereof, $G'_{170}$ in dyne/cm$^2$, satisfy the following relation;

$$-(2/15)Dv+3.5 \leqq \log G'_{170} \leqq -(3/15)Dv+5.5,$$

and fixing said toner image by a fixing roller which is covered by a surface layer comprising a fluorine-containing resin.

* * * * *